US005539144A

United States Patent [19]

Sherman

[11] Patent Number: 5,539,144

[45] Date of Patent: Jul. 23, 1996

[54] FLOATING TREMOLO WITH OPTIMIZED FRICTIONAL FORCES

[76] Inventor: Gery Sherman, 12808 Teaberry Rd., Wheaton, Md. 20906

[21] Appl. No.: 402,317

[22] Filed: Mar. 10, 1995

Related U.S. Application Data

[63] Continuation of Ser. No. 913,679, Jul. 15, 1992, abandoned, which is a continuation-in-part of Ser. No. 819,584, Jan. 9, 1992, Pat. No. 5,373,769, which is a continuation-in-part of Ser. No. 710,211, Jun. 4, 1991, abandoned.

[51] Int. Cl.[6] ..... G10D 3/00; G10D 1/08

[52] U.S. Cl. ..... 84/313; 84/293; 84/267; 84/297 R

[58] Field of Search ..... 84/313, 291, 293, 84/267, 297 R, 268, 269, 314 N

[56] References Cited

U.S. PATENT DOCUMENTS

| | | | |
|---|---|---|---|
| 2,073,226 | 3/1937 | Schrickel | 84/313 |
| 2,741,146 | 4/1956 | Fender | 84/313 |
| 3,237,502 | 3/1966 | Mosley | 84/313 |
| 3,411,394 | 11/1968 | Jones | 84/313 |
| 3,971,286 | 7/1976 | Borell | 84/298 |
| 4,171,661 | 10/1979 | Rose | 84/313 |
| 4,285,262 | 8/1981 | Scholz | 84/313 |
| 4,304,163 | 12/1981 | Siminoff | 84/314 |
| 4,453,443 | 6/1984 | Smith | 84/298 |
| 4,453,445 | 6/1984 | Smith | 84/298 |
| 4,457,201 | 7/1984 | Storey | 84/313 |
| 4,497,236 | 2/1985 | Rose | 84/298 |
| 4,517,874 | 5/1985 | Fender | 84/314 N |
| 4,681,010 | 7/1987 | Wilkinson | 84/313 |
| 4,787,285 | 11/1988 | Goto | 84/313 |
| 4,798,119 | 1/1989 | Leifheit | 84/314 N |
| 4,852,448 | 8/1989 | Hennessey | 84/313 |
| 4,864,909 | 9/1989 | Toney | 84/313 |
| 4,869,145 | 9/1989 | Evans | 84/313 |
| 4,928,564 | 5/1990 | Borisoff et al. | 84/313 |
| 5,113,737 | 5/1992 | Grerory | 84/293 |

OTHER PUBLICATIONS

Hamer Products Brochure, Hamer Guitars U.S.A., Arlington Heights, Illinois, pp. 2–3 (1992).

1992 Carvin Product Catalog, Carvin Corp., Escandido, California, pp. 27 and 44 (1992).

*Primary Examiner*—Cassandra C. Spyrou

[57] ABSTRACT

A guitar having a body, a headstock, a neck, a plurality of strings, and a tremolo device including at least two bevelled-slotted pivot points. The bevelled-slotted pivot points have a top and bottom bevel which lowers the friction of the bevelled-slotted pivot points against the v-shaped grooves of the studs. The tremolo includes spring claw fasteners that support the tremolo system and allow the tremolo height or position to be adjusted without affecting the structural integrity of the tremolo. A tremolo arm assembly is provided which allows the tremolo arm to remain in a fixed position to prevent interruption of play.

38 Claims, 6 Drawing Sheets

FLOATING TREMOLO WITH OPTIMIZED FRICTIONAL FORCES

RELATED PATENTS

This patent is a continuation of patent application Ser. No. 07/913,679, having a filing date of Jul. 15, 1992, now abandoned, which is a continuation-in-part of patent application entitled, GUITAR APPARATUS, having Ser. No. 07/819,584, now U.S. Pat. No. 5,373,769 and filing date of Jan. 9, 1992, which is a continuation-in-part of a patent application entitled, GUITAR APPARATUS, having Ser. No. 07/710,211 and filing date of Jun. 4, 1991, now abandoned.

BACKGROUND OF THE INVENTION

This invention relates to musical instruments known as guitars, and more particularly to guitars equipped with tremolo devices for dynamically altering the pitch of the guitar.

DESCRIPTION OF THE RELEVANT ART

Tremolo devices are well known to those skilled in the musical instruments art for varying the pitch of a guitar. The tremolo is mounted on the body of the guitar and becomes an integral part of the guitar. Each of the guitar strings is held taut at one end by the tremolo, and the other end of the each of the guitar strings connects to a respective tuner, with the tuners mounted on a headstock. The guitar strings are taut and traverse over the length of the neck of the guitar to the headstock. At the end of the neck, which is connected to the headstock, the strings pass over or through a nut.

While playing a guitar equipped with a tremolo, a guitarist can vary the pitch of the strings by tilting the tremolo arm, which increases or decreases string tension.

A common and frustrating problem that exists with all prior art guitars equipped with tremolo devices is that the guitar strings cannot stay in tune during abusive, or even normal, play of the guitar, requiring frequent tuning of the strings.

Several apparatus have been proposed for keeping the guitar in tune while the tremolo device is in use. U.S. Pat. No. 4,171,661 to Rose discloses a tremolo device which employs a base plate anchored to the body of the guitar. A key to the Rose '661 disclosure is that the base plate for the tremolo device is anchored so that the base plate preferably returns to the original position where the base plate was located prior to varying the tremolo device. The Rose '661 patent also uses string restraining assemblies and clamping devices at the bridge and nut to prevent the strings from sliding across the bridge and nut during use of the tremolo device.

The Rose '661 patent thus describes a technique for maintaining the pitch of the instrument by clamping the strings at the nut and at the bridge portion of the tremolo device; however, according to U.S. Pat. No. 4,497,236 to Rose, the technique of the Rose '661 patent requires a complex tuning procedure, i.e. the clamps at the nut are loosened, the strings are tuned, and then the clamps are retightened. This procedure is repeated until all of the strings are properly pitch tuned with all of the clamps tightened.

In addition, prior art tremolo devices do not provide for the tremolo device to return to its original position after and during use, causing the guitar strings to go out of tune. Furthermore, friction or interference experienced at the location where the tremolo base plate pivots on the studs decreases the responsiveness of prior art tremolo devices, where tapered slots of the base plate make contact with the head and shoulders of the studs in such a manner that grinding of these respective parts occurs, instead of a clean, sharp, isolated pivoting action.

There are two types of tuning for a string, both of which are necessary to achieve a properly tuned guitar. The first type of tuning is called pitch tuning. Pitch tuning is accomplished by increasing or decreasing the tension of the string, usually by means of a tuner. The higher the string tension, the higher the pitch of the string, and conversely, the lower the string tension, the lower the pitch of the string.

The second type of string tuning is referred to as harmonic tuning or intonation. Intonation of a string is accomplished by varying the distance between the string's critical contact points at the nut and at the bridge, usually by means of adjustable bridge saddles. The longer the distance between the two critical contact points, the flatter the intonation, and conversely, the shorter the distance between the two critical contact points, the sharper the intonation.

Hence, for the strings on a guitar to be considered in tune, each string must not only be adjusted to its proper pitch, but each string must also be adjusted precisely and accurately to its proper length.

A fine-tuning mechanism disclosed in the Rose '236 patent incorporates, in the structure of the mechanism, the bridge element of the guitar which clamps the string and which provides the critical contact point for intonation tuning. When the fine-tuning mechanism is adjusted to alter the pitch by increasing or decreasing string tension, the bridge saddle pivots about a pin which inherently causes a variation in the distance between the critical contact points. At the same time that the fine-tuning mechanism changes the string tension, the length of the string is changed, affecting the intonation, so the string cannot be tuned by the fine-tuning mechanism alone. Even a slight variation in the distance of the string between the nut and the bridge causes a loss of intonation.

Also, prior art guitars include locking nuts which add complexity to the tuning process and the string changing process. Further, in the prior art, the pitch may only be varied by the tremolo arm.

Another problem associated with the prior art tremolo devices is the design of the tremolo arm assembly, which is required to stay tight so that the tremolo arm can remain in a fixed position. Constant swiveling of the arm, in and out of playing position, causes the tremolo arm assembly to loosen, which in turn causes the tremolo arm to be unable to stay in a fixed position. Also, prior tremolo arm assemblies are not manufactured with precision and are difficult to tighten and adjust due to deficient design.

A further problem associated with prior art tremolo devices is the means by which the tremolo is attached and secured to the body of the guitar. Prior art tremolo devices use wood screws or their functional equivalent to mount the tremolo to the guitar body. These same wood screws are later rotated to adjust the positioning or height of the tremolo. Repeated tightening and loosening of the wood screws to adjust the height or positioning of the tremolo weakens the support provided by these screws, which can eventually lead to failure and irreparable damage to the guitar. Also, a weakened support of the tremolo device can cause the strings to go out of tune easily since the tremolo does not always return to the original position after use.

OBJECTS OF THE INVENTION

A general object of the invention is to provide an improved tremolo device for varying the pitch of the strings on a guitar which does not require a fine-tuning mechanism or a clamping device at the nut.

A further object of the invention is to improve the responsiveness of the pivoting action of the tremolo device, and to improve the function of the tremolo arm assembly which holds the tremolo arm in a fixed position.

Another object of the invention is to create a tremolo mechanism that permits the guitar strings to be brought into a precise state of tune without variance throughout all ranges of tremolo action and play, and that also allows fine tuning of the pitch of a guitar string without altering its intonation.

Another object of the invention is to create an alternate means for varying the pitch of the strings other than using the tremolo arm, and to reduce the complexity of the string changing process, as well as the complexity of the tuning process.

Another object of the invention is to provide a tremolo device that is simple, effective and easy to use, that has sound structural support, and that allows repeated adjustment or leveling of the tremolo system on the guitar body without affecting the structural integrity of the system.

SUMMARY OF THE INVENTION

According to the present invention, as embodied and broadly described herein, a guitar is provided which has a body, a headstock, a neck, a tremolo and a plurality of strings. The neck connects at a first end to the body and at a second end to the headstock. The plurality of strings stretch from the headstock to the bridge portion of the tremolo.

The present invention includes the elements of the tremolo guitar which allow the guitar to remain in tune during extensive, abusive play and which provide desirable characteristics such as stability, simplicity, responsiveness and precision.

Two tremolo embodiments are presented which achieve the desired result of having a guitar, equipped with a tremolo, which remains in tune during play. The first tremolo embodiment eliminates the requirement of having a fine-tuning mechanism and locking nut by incorporating other components to achieve the desired results. The location and alignment of locking tuners and strings, in combination with a low-friction nut, allow the strings to stretch freely during use of the tremolo and to return to the original position, preventing the strings from going out of tune.

The first embodiment of a tremolo device may also include extended screws attached to the bridge saddles to clamp the strings of the guitar. These extended screws allow the guitarist to increase the pitch of the guitar without having to use the tremolo arm.

The second embodiment of the tremolo device includes a new fine-tuning mechanism and a locking nut. The new fine-tuning mechanism, when used with a locking nut, allows the pitch of the strings to be adjusted without altering the intonation of the strings. Thus, the strings are tuned without the complicated process of having to loosen the clamps at the nut, retuning the strings and then retightening the clamps at the nut.

This invention also provides a new tremolo base plate having bevelled-slotted pivot points. The bevelled-slotted pivot points, in combination with specially designed studs, reduce the friction created at the pivot point of the tremolo and provides increased responsiveness and fluidity during play. Also, stud casings are used to improve the structural integrity to the tremolo system. The new tremolo base, studs and stud casings are used cooperatively with the first and second tremolo embodiments.

This invention also includes a new spring claw fastener which allows for simple adjustment of the tremolo system without disturbing the structural integrity of the system. The springs of the tremolo device are connected to a spring claw which is secured to the guitar body by the specially designed spring claw fastener. The new spring claw fastener improves the responsiveness of the tremolo system and also provides a tremolo system with more structurally sound support.

The present invention also includes a new tremolo arm assembly which stays tight, preventing the tremolo arm from rotating freely and interrupting play; which is easy to adjust when the tremolo is mounted on the guitar body; and which is precisely designed and manufactured to be connected onto the base plate, eliminating both unwanted play in the tilting movement of the tremolo arm and unwanted stiffness in the rotation of the tremolo arm.

Additional objects and advantages of the invention are set forth in part in the description which follows, and in part are obvious from the description, or may be learned by practice of the invention. The objects and advantages of the invention also may be realized and attained by means of the instrumentalities and combinations particularly pointed out in the appended claims.

BRIEF DESCRIPTION OF THE DRAWINGS

The accompanying drawings, which are incorporated in and constitute a part of the specification, illustrate preferred embodiments of the invention, and together with the description serve to explain the principles of the invention.

DETAILED DESCRIPTION OF THE PREFERRED EMBODIMENTS

Figure 1A:
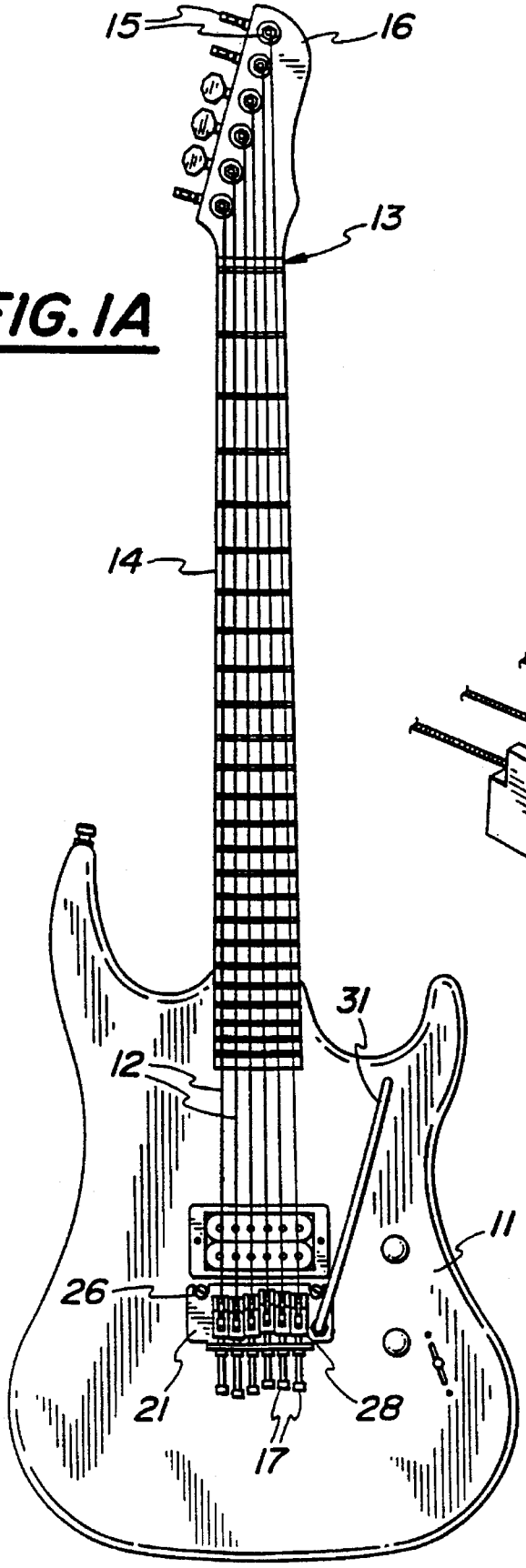
FIG. 1A is a plan view of a guitar without a fine-tuning mechanism and locking nut.

Reference is now made in detail to the present preferred embodiments of the invention, examples of which are illustrated in the accompanying drawings, wherein like reference numerals indicate like elements throughout the several views.

Figure 1B:
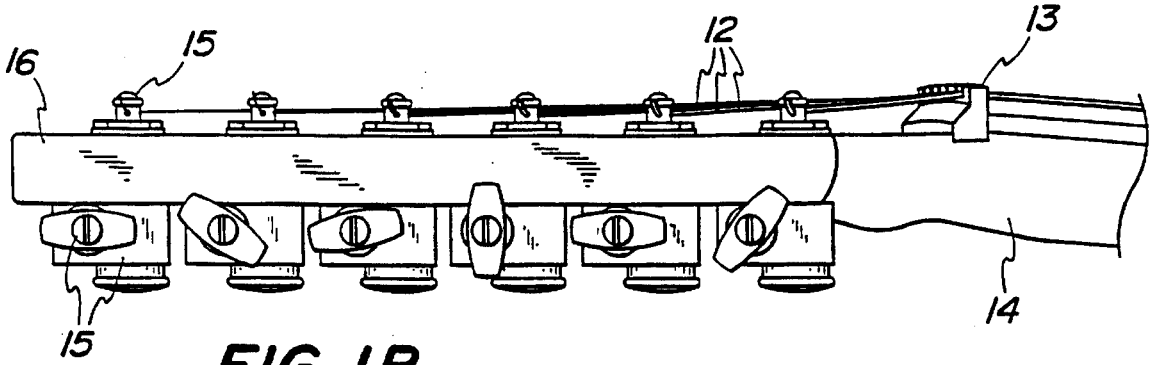
FIG. 1B is a side view of the headstock region of the guitar without a fine-tuning mechanism and locking nut.
Figure 2:
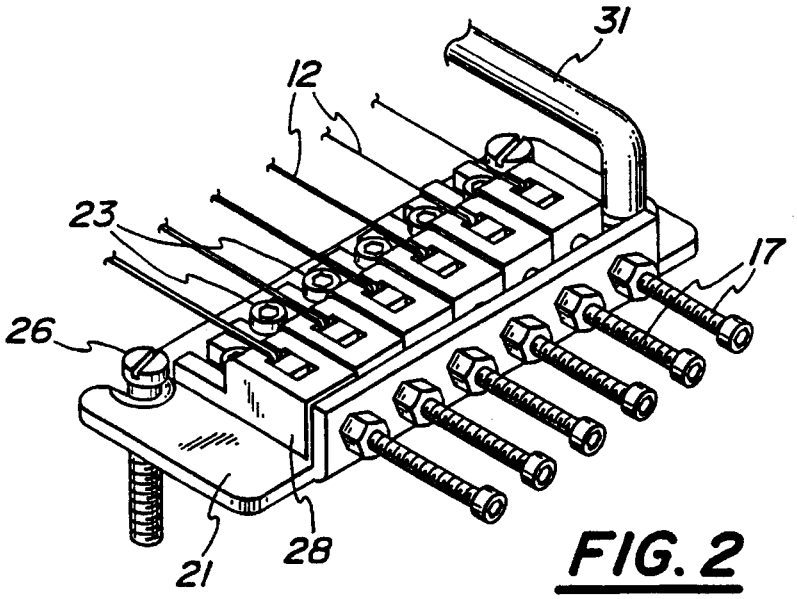
FIG. 2 shows an embodiment of a tremolo device without a fine-tuning mechanism.

In the exemplary arrangement shown in FIGS. 1A and 1B, the basic components of the guitar, having a first embodiment of a tremolo device that eliminates the use of a fine-tuning mechanism and locking nut at the headstock, are illustrated as a body 11, a headstock 16, a neck 14 connecting at a first end to the body 11 and at a second end to the headstock 16, a plurality of locking tuners 15 and a plurality of strings 12. FIGS. 1A and 1B also show the nonlocking-low-friction nut 13, the tremolo base plate 21, the tremolo arm 31, the threaded studs 26, the bridge saddles 28, and the long length screws 17.

The plurality of locking tuners 15 are attached to the headstock 16. The side view of headstock region of the guitar, as illustrated in FIG. 1B, shows the headstock 16, tilting away from the neck 14 at an angle of approximately three degrees from the plane of the flat surface of the neck 14. The arrangement of the locking tuners 15 is also shown in FIG. 1B.

By tilting the headstock 16 back from the elongated direction of the neck 14 at this low angle, the friction of the strings 12 is minimized across the nonlocking-low-friction nut 13. The angle, however, can not be so low as to allow the strings 12 to lose contact with the nonlocking-low-friction nut 13 or reduce the force of the strings against the nut to the point that undesired sounds result during play.

Figure 5:
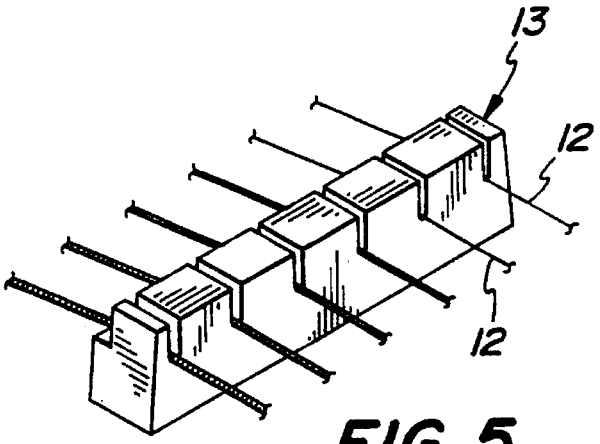
FIG. 5 illustrates a nonlocking-low-friction nut.
Figure 6:
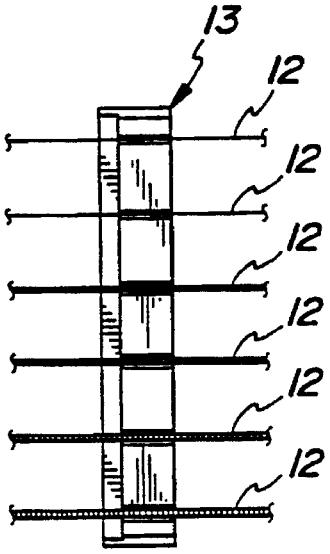
FIG. 6 illustrates a top view of the nonlocking-low-friction nut.

Each end of the plurality of strings 12 passes over the nonlocking-low-friction nut 13 in a slotted section thereof near the neck 14. The nonlocking-low-friction nut 13 is disposed on the end of the neck 14 adjacent the headstock 16. The nonlocking-low-friction nut 13 has a plurality of slots with each slot preferably having a flat bottom for passing one of the plurality of strings therethrough. The nonlocking-low-friction nut 13 is shown in FIGS. 5 and 6. By experimentation, a nonlocking-low-friction nut 13 made from a plastic called DELRIN 500CL™ produced the best results for providing low friction to the strings passing therethrough, where DELRIN 500CL™ is a chemically lubricated version of polyoxymethylene, a crystalline thermoplastic homopolymer made by DuPont by the polymerization of formaldehyde.

Figure 11:
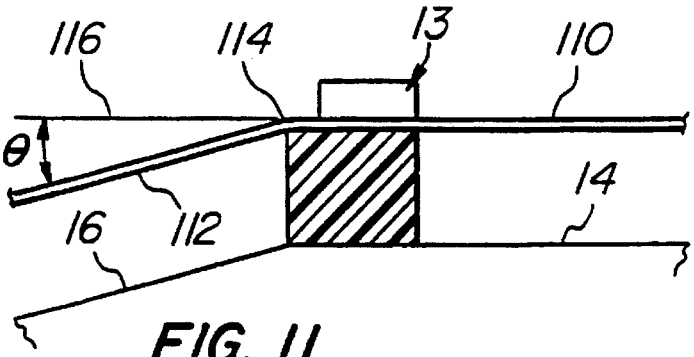
FIG. 11 illustrates a string bending towards the headstock at a common angle θ across the radius of a nonlocking-low-friction nut.

The locking tuners 15 are attached to the headstock 16 in such a manner with the height of each of the locking tuners 15 individually determined so that each of the strings 12 bend towards the headstock 16 at a common angle of less than fifteen degrees across the radius of the nonlocking-low-friction nut 13, i.e. each of strings 12 bends, as illustrated in FIG. 11, at an angle θ common to all of the strings 12. As shown in FIG. 11, a first portion 110 of each of strings 12 extends over the neck 14, and a second portion 112 of each of the strings 12 extends over the headstock 16, with each of the strings 12 bending at a vertex 114. In reference to an imaginary straight line extension 116 of the first portion 110 of each of strings 12, the second portion 112 of each of the strings 12 bends away from the imaginary extension 116 towards the headstock 16 at the common angle θ, as shown in FIG. 11.

Also, the locking tuners 15 are arranged with the strings 12 running in a straight line and parallel to and equidistant from one another, as viewed from the front of the guitar, from the connection at the locking tuners 15, across the nonlocking-low-friction nut 13, down the length of the neck 14 and to the bridge saddles 28 located on the base plate 21 of the tremolo device.

During experimentation, the best sound, precision, and responsiveness of the guitar was achieved when the headstock 16 was tilted back from the neck 14 at approximately three degrees, and when each of the plurality of strings bend at a common angle θ of approximately three degrees across the radius of the nonlocking-low-friction nut 13, as shown in FIG. 11. However, exceptional results also were obtained when the headstock 16 is tilted back from the neck 14 at an angle between three degrees and fifteen degrees and each of the plurality of strings bend toward the headstock 16 at the common angle θ, between three degrees and fifteen degrees, across the radius of the nonlocking-low-friction nut 13. When the headstock 16 is tilted back beyond fifteen degrees from the neck 14, a noticeable loss in responsiveness and precision is observed.

By having each of the plurality of strings 12 run parallel to one another down the headstock 16 and through the nonlocking-low-friction nut 13, and having each of the strings bend at the common angle θ across the radius of the nonlocking-low-friction nut 13, as shown in FIG. 11, the friction of the strings 12 is minimized against the nonlocking-low-friction nut and each string experiences approximately the same amount of friction at the nonlocking-low-friction nut. Thus, when the tremolo is used and then deactivated, the tremolo returns to the original position and each string returns to the proper pitch because the strings, experiencing little or no friction at the nonlocking-low-friction nut, are not prevented from moving to their original positions.

Figure 3A:
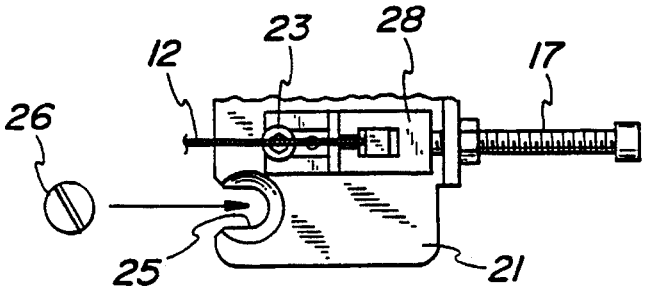
FIG. 3A is a plan view of a portion of the tremolo base plate showing the location of the component parts of the base plate including a bridge saddle, a stud and a bevelled-slotted pivot point.

Referring to FIGS. 2, 3A–3F, and 4 jointly, the present invention is particularly illustrated with the modifications to the tremolo device of FIG. 3A. Certain components of the tremolo device of FIGS. 2, 3A and 4, without the improvements according to the present invention, were disclosed in U.S. Pat. No. 4,171,661 to Rose, which is incorporated herein by reference.

By using a nonlocking-low-friction nut 13, and eliminating the use of a locking nut or other clamping device at the nut, the guitar can be easily pitch tuned by turning the locking tuners 15. The intonation of each string, or harmonic tuning, is established or adjusted by moving the corresponding bridge saddle 28 which determines the length of the string between the nonlocking-low-friction nut 13 and the bridge saddle 28.

The tremolo device of FIGS. 2, 3A–3G and 4 comprises a base plate 21, at least two threaded studs 26, a tremolo arm assembly including a tremolo arm 31, a plurality of bridge saddles 28, a plurality of bridge saddle mounting screws 23, a plurality of long length screws 17, a tremolo spring arm 39, a plurality of springs 41, a spring claw 43 and at least two spring claw fasteners 52.

Figure 3B:
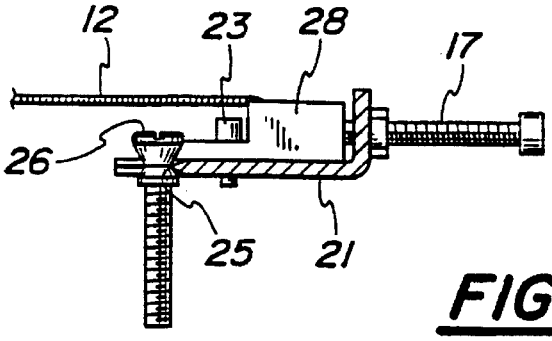
FIG. 3B is a side view of the tremolo base plate and the threaded stud.
Figure 3C:
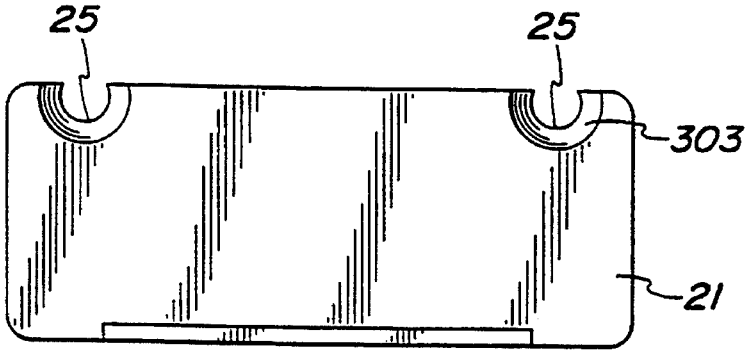
FIG. 3C is a plan view of the tremolo base plate showing the bevelled-slotted pivot points.
Figure 3D:
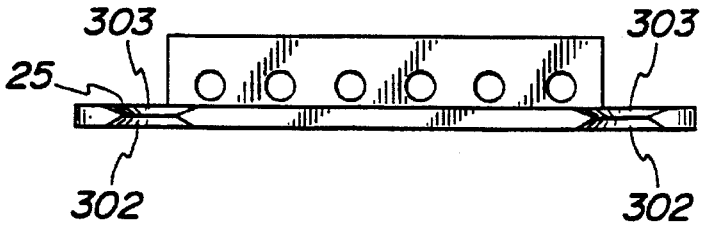
FIG. 3D is a front view of the tremolo base plate showing the top bevel and bottom bevel of the bevelled-slotted pivot points.
Figure 3E:
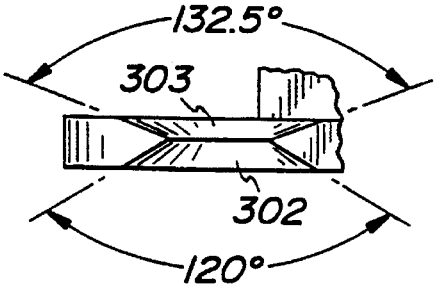
FIG. 3E shows the preferred angles of the top bevel and the bottom bevel.
Figure 3F:
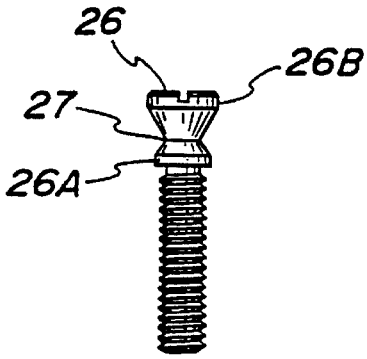
FIG. 3F illustrates a threaded stud having a V-shaped notch.
Figure 3G:
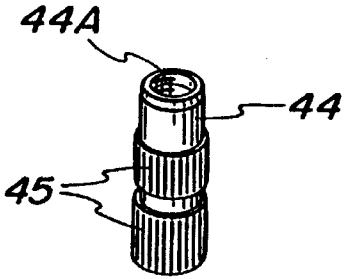
FIG. 3G shows a stud casing having exterior grooves.
Figure 4:
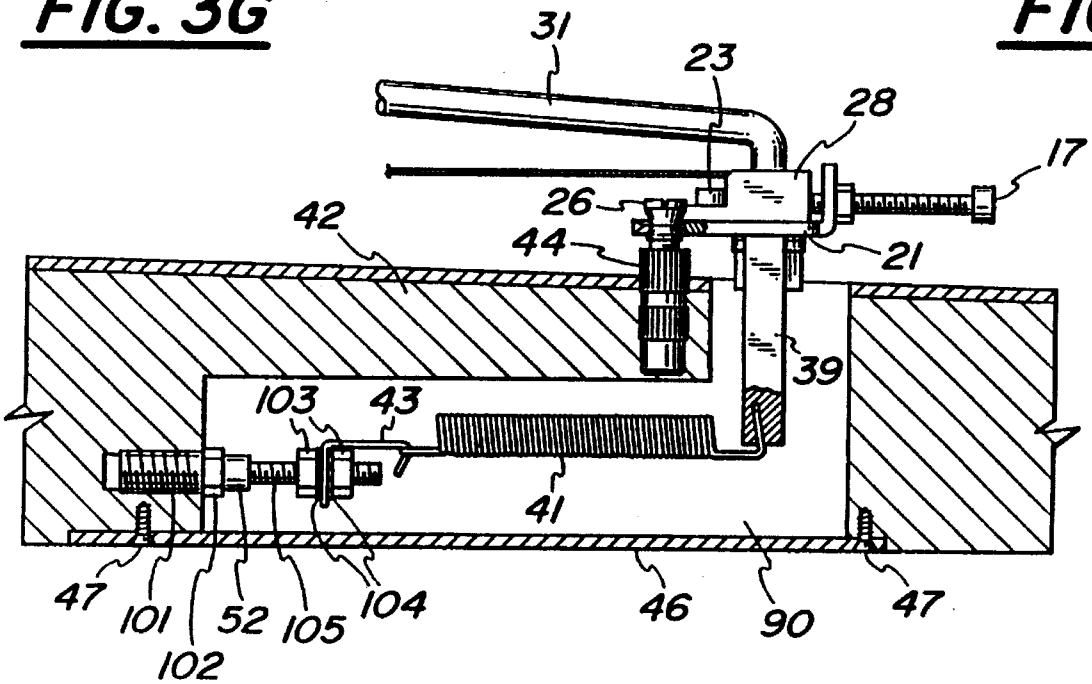
FIG. 4 shows a cross-sectional view of the tremolo device without a fine-tuning mechanism.

The threaded studs 26 may be screwed into stud casings 44 having appropriate interior threads 44A to receive and secure the threaded studs, as illustrated in FIG. 3G. The stud casings 44 are held into the wooden block portion 42 within the body 11 of the guitar, as illustrated in FIG. 4. As shown in FIG. 3G, the stud casings 44 have exterior grooves 45 which provide friction for securing the stud casings into the guitar body 11.

The tremolo base plate 21 is held in place by the bevelled-slotted pivot points 25, having a top bevel 303 and a bottom bevel 302, being forced against the threaded studs 26 by the tension in the strings 12. The bevelled-slotted pivot points 25 of the base plate 21 fit into the V-shaped notch 27 located between the head 26B and the lower flanged shoulder 26A of the threaded studs 26.

FIGS. 3A and 3B illustrate how the bevelled-slotted pivot points 25 of the base plate 21 fit into the V-shaped notches of the threaded studs 26. The V-shaped notches 27 are located between the stud heads 26B and the flanged shoulders 26A of the threaded studs.

As illustrated in FIG. 3C, each bevel has the same diameter on the base plate 21. Each diameter of the bevels is slightly larger than the diameter of the V-shaped notches 27 of the threaded studs 26. In a preferred embodiment, the base plate, including the bevelled-slotted pivot points which reside on the base plate, is manufactured from hardened tool steel. As shown in FIGS. 3D and 3E, the top bevel 303 and the bottom bevel 302 form a small, precise, hard and sharp edge which lowers the friction of the bevelled-slotted pivot point 25 within the V-shaped notches 27 of the hardened, tapered tool steel studs 26 where the bevelled-slotted pivot point rests. The threaded stud 26 has a V-shaped notch 27 as shown in FIG. 3F.

The bevelling of the bevelled-slotted pivot points, which pivots at the V-shaped notches of the threaded studs, allows for free and precise movement in the tilting direction of the tremolo. When the tremolo is deactivated, the tremolo immediately returns to its original position, maintaining the initial tension and tuning of the strings.

A preferred embodiment of the tremolo base plate 21 has bevelled-slotted pivot points 25 which include a top bevel having an included angle of approximately 132.5 degrees and a bottom bevel having an included angle 302 of approximately 120 degrees. Also, both the top and bottom bevels have a diameter of approximately 0.450 inches on a base plate 21, which is approximately 13/128 inches thick. Experiments revealed the most outstanding results when these dimensions were used.

Excellent results are obtained when the top bevel 303 has an included angle which ranges from 105 degrees to 160 degrees with a corresponding range in the lower bevel 302 of 105 to 160 degrees. Outstanding results are obtained with the base plate 21 having a thickness ranging from 5/64 to 1/8 inches.

The object of having a base plate 21 with bevelled-slotted pivot points is to form a small, precise, sharp edge for lowering the friction of the bevelled-slotted pivot point against the V-shaped notch of the corresponding threaded stud upon which the bevelled-slotted pivot point pivots. The angle of the V-shaped notch 27 of the threaded studs 26 must be sufficiently large for allowing the sharp edge of the bevelled-slotted pivot point 25 to fit securely into the V-shaped notch 27 of the threaded stud while preventing any other part of the base plate from making contact with the threaded stud. Accordingly, the only parts of the base plate that contact the threaded studs are the sharp edges of the bevelled-slotted pivot points which only contact the V-shaped notches or grooves of the studs. As a result, less friction, thus greater precision, is achieved with a true pivoting action than with the grinding action that is experienced with the designs found in the prior art.

The tremolo provides the guitarist with an alternate means for varying the pitch of the strings. By pressing the palm of the hand down on the long length screws 17 that extend out past the base plate 21 from the bridge saddles 28, the guitarist may vary the pitch of the strings. This advantage is brought about by using long length screws 17 to clamp the strings 12 in the bridge saddles 28, mounting the tremolo device approximately one quarter to one half inch above the body 11 of the guitar and eliminating the need for a fine-tuning mechanism at the bridge.

Prior to the instant invention, resting the hand on the bridge, a very common playing technique, meant coming into contact with the fine-tuning mechanism causing the guitar to go out of tune. Because the need for a fine-tuning mechanism is eliminated by the present invention, the guitarist's hand can rest on the bridge while playing without causing the guitar to out of tune.

Figure 9:
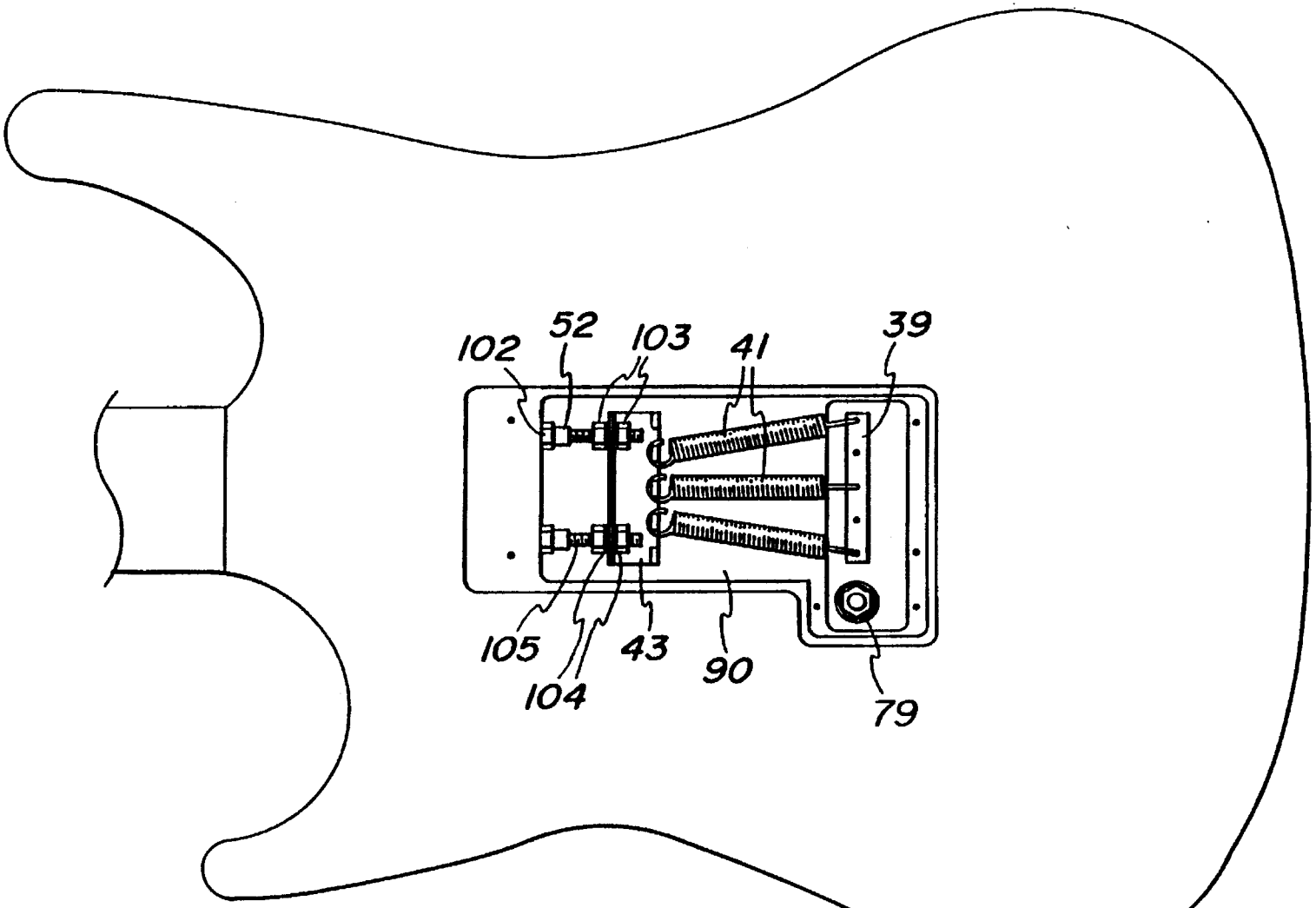
FIG. 9 shows the rear of a guitar body and illustrates a support system of a tremolo and a tremolo arm assembly nut.

The tremolo cavity 90 on the back side of the guitar body 11, as illustrated in FIGS. 4 and 9, houses the springs 41, the spring claw 43, the spring claw fastener 52, and the spring arm 39 of the tremolo device. The tremolo cavity 90 has two covering plates 46 and 46A made of plastic or other appropriate material. The covering plates 46 and 46A cover the tremolo cavity 90 and are secured to the back of the guitar by screws 47. The covering plates 46 and 46A provide access to the tremolo device and tremolo arm assembly, respectively. Covering plate 46A, not shown in the figures, covers only the portion of the tremolo cavity containing the split-hexagonal nut 79 of the tremolo arm assembly, which is discussed in detail below.

The tremolo spring arm 39 is fastened onto and beneath the tremolo base plate 21 by screws, or by being formed integrally therewith, or by other appropriate means. The springs 41 are attached at one end to the tremolo spring arm 39 and are held at the other end by a spring claw 43. The spring claw is held in place by a plurality of spring claw fasteners 52.

Figure 10:
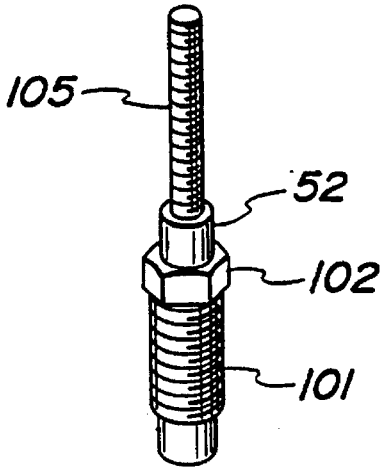
FIG. 10 illustrates a spring claw fastener.

The spring claw fastener 52 is detailed in FIG. 10. The threaded mounting shaft 101 is secured into the body 11 of the guitar. The hexagonal shoulder 102 may be used for installation of the spring claw fastener 52 into the body 11 of the guitar.

The two nuts 103 of the spring claw fastener 52 are used to secure the spring claw 43 to the spring claw fastener 52 along the threaded tremolo-level-adjustment shaft 105. Two star washers 104 may optionally be used with the two nuts 103 to secure the spring claw 43 to the spring claw fastener 52. Also, the two nuts 103 allow adjustment of the position or height of the tremolo device by changing the point of connection of the spring claw 43 along the tremolo-level-adjustment shaft. The connection point of the spring claw 43 along the tremolo-level-adjustment shaft 105 is changed by loosening the nuts 103 and then retightening them along the tremolo-level-adjustment shaft 105 at the proper location.

The spring claw fasteners 52 provide the structural stability of the tremolo system by mounting the tremolo to the guitar body 11 and resisting the tensional forces generated in both the guitar strings 12 and the springs 41. The spring claw fasteners 52 detailed herein represent a tremendous improvement over prior art fasteners, wood screws. Prior art tremolo systems are designed so as to connect the spring claw to the head of the wood screws. The height or positioning of the prior art tremolo is then adjusted by tightening or loosening the wood screw, which could weaken the support the wood screws provide and lead to failure of the tremolo system.

Figure 7:
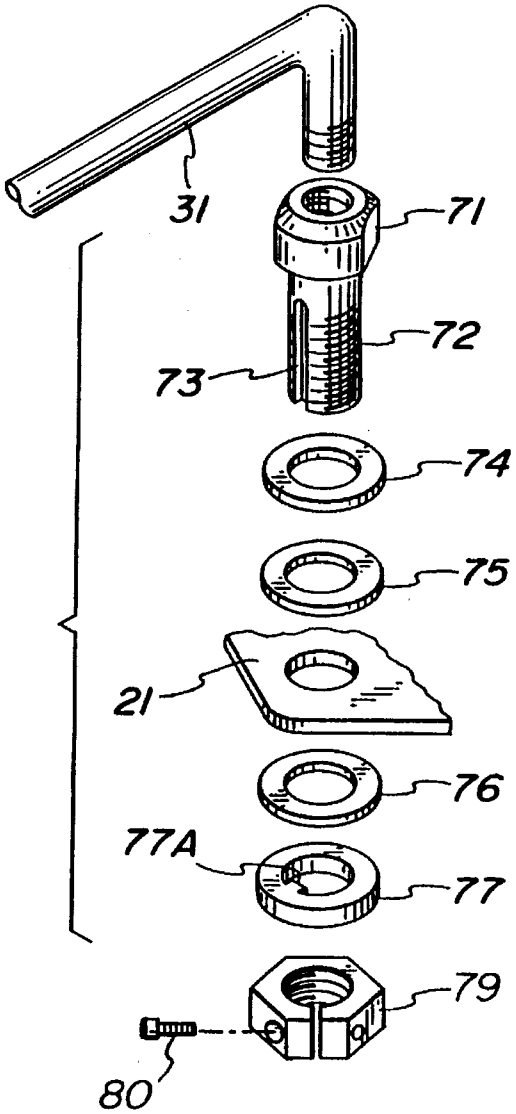
FIG. 7 shows an exploded view of a tremolo arm assembly attached to a base plate.

An exploded view of the new tremolo arm assembly is illustrated in FIG. 7. The tremolo arm 31 is an elongated, cylindrical shaft that bends at a first end, with the first end having threads which connect the tremolo arm 31 into a two flat sided shoulder 71 of the threaded-tremolo-arm-assembly shaft 72, i.e. the shoulder 71 has two sides which are flat surfaces. The two flat sided shoulder is used during installation and adjustment of the tremolo arm assembly which is connected to the tremolo base plate 21.

The threaded-tremolo-arm-assembly shaft 72 extends below the two flat sided shoulder 71, with the threaded-tremolo-arm-assembly shaft 72 having a key-way groove 73 running along the length of the threaded-tremolo-arm-assembly shaft. The key-way groove 73 is cut out of the threads of the threaded-tremolo-arm-assembly shaft 72 and has a depth greater than the depth of the threads of the threaded-tremolo-arm-assembly shaft 72. Also, the width of the key-way groove 73 is greater than the distance between the threads of the threaded-tremolo-arm-assembly shaft 72.

A solid washer 74 is placed along the threaded-tremolo-arm-assembly shaft 72 below the two flat sided shoulder 71. Below the solid washer 74, a first washer 75, made of highly resistant material having low friction, is placed along the threaded-tremolo-arm-assembly shaft 72. The threaded-tremolo-arm-assembly shaft 72 is then placed through the base plate 21. Below the base plate 21 and along the threaded-tremolo-arm-assembly shaft 72, a second washer 76 made of highly resistant material having low friction is placed. By experimentation, the use of highly resistant, low friction washers 75, 76 made from a plastic called DELRIN 500CL™ produced the best results for providing low friction to the new tremolo arm assembly, as shown in FIG. 7, where DELRIN 500CL™ is a chemically lubricated version of polyoxymethylene, a crystalline thermoplastic homopolymer made by DuPont by the polymerization of formaldehyde.

Below the second washer 76, the key-way washer 77 is placed along the threaded-tremolo-arm-assembly shaft 72 with the key portion 78 slidably engaging the key-way groove 73. The key portion 78 of the key-way washer 77 is wider than the distance between the threads of the threaded-tremolo-arm-assembly shaft 72 and extends into the key-way groove 73 at a depth that is greater than the depth of the threads of the threaded-tremolo-arm-assembly shaft 72. The dimensions of the key portion 78 and the key-way groove 73 prevent the key portion of the key-way washer from sliding into the threads of the threaded-tremolo-arm-assembly shaft 72. Thus, the key-way washer 77 helps prevent the tremolo arm assembly from becoming loose during use of the tremolo and interfering with the guitarist.

A split-hexagonal nut 79 made from stiff material is provided, as shown in FIG. 7, having a slot as well as a first screw hole with threads aligned with a second screw hole with threads. The combination of the first and the second screw holes allow a screw 80 to pass through the first and second screw holes across the slot of the split-hexagonal nut 79 by threading the screw 80 through the threads of the each of the threads of the first and the second screw holes. With the screw 80 threading and passing through one side of the split-hexagonal nut 79, through the first screw hole, across the slot of the split-hexagonal nut 79, and through the second screw hole, the split-hexagonal nut 79 is screwed along the threaded-tremolo-arm-assembly shaft 72 to tighten the new tremolo arm assembly of the two flat sided shoulder 71, the solid washer 74, the first washer 75, the base plate 21, the second washer 76, the key-way washer 77, and the split-hexagonal nut 79.

With the tremolo arm assembly shown in FIG. 7 is tightened, the screw 80 is tightened as desired to clamp the threads of the split-hexagonal nut 79 tight against the threaded-tremolo-arm-assembly shaft 72, as well as clamping the split-hexagonal nut together. By tightening the screw 80, the friction between the split-hexagonal nut 79 and the threaded-tremolo-arm-assembly shaft 72 is increased, causing the new tremolo arm assembly to stay tight and to prevent the tremolo arm from rotating freely and interrupting play of the guitar.

Once installed, the tremolo arm assembly can be adjusted easily through a hole in the back of the guitar by removing the covering plate 46A, by loosening the screw 80 with a screwdriver or an Allen wrench, and then by placing a socket over the split-hexagonal nut 79 while placing a wrench over the two flat sided shoulder 71. The new tremolo arm assembly stays tight, preventing the tremolo arm 31 from interrupting play, and also eliminates unwanted play in the tilting movement of the tremolo arm and unwanted stiffness in the rotation of the tremolo arm.

The present invention with the aforementioned structural changes to the guitar disclosed in the Rose '661 patent has several advantages. String changing is simpler, easier, less complex and cumbersome. This advantage is brought about by eliminating the locking nut and the use of locking tuners. Also, the tremolo arm does not loosen up when repeatedly swiveled in and out of playing position and stays in a fixed position, due to the improved design of the locking tremolo arm assembly which holds the tremolo arm in a fixed position.

The tuning process is simpler and less complex with the first embodiment of the tremolo device and assorted improvements of the present invention. Additionally, the guitar strings can be maintained in a highly precise state of tune without variance throughout all ranges of tremolo action and play. These advantages result from eliminating the need for a fine-tuning mechanism, improving the responsiveness of the tremolo device, eliminating the clamping device at the nut, using a nonlocking-low-friction nut, having a low headstock angle, including locking tuners, aligning each string parallel to each other from the tremolo to the locking tuners and individually determining the height of each locking tuner so as to have a common angle θ of the strings bending towards the headstock 16, as shown in FIG. 11.

With the improvements of the present invention, the existing range of producible tonal effects and nuances is also improved and enhanced with a more vocal musical quality to them, from the improved responsiveness of the pivoting action of the tremolo device.

Figure 8:
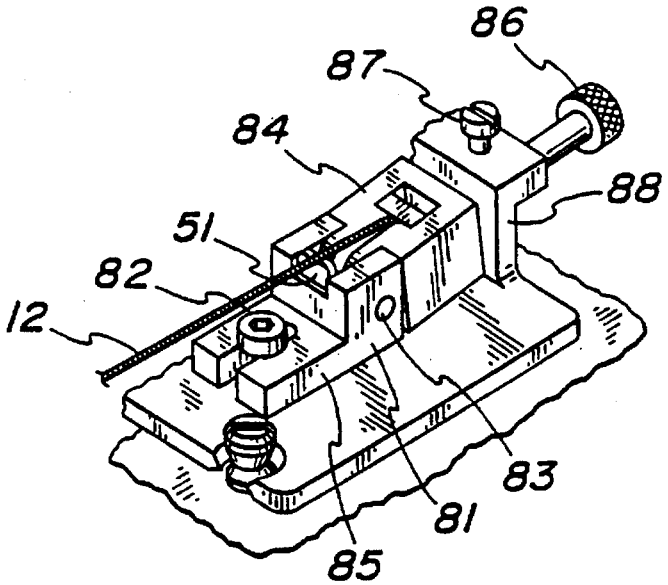
FIG. 8 shows a fixed intonation point on a fine-tuning mechanism.

FIG. 8 illustrates the fine-tuning mechanism of the second embodiment of a tremolo device. The improved fine-tuning mechanism in FIG. 8 serves its intended function of fine-tuning the pitch without disrupting the intonation. This is possible because the improved fine-tuning mechanism of FIG. 8 has a fixed intonation point 51 built into it as an integral part of its design. This underscores the ability of the guitar to be brought into a precise state of tune. The fine-tuning mechanism of FIG. 8 is an improvement and modification of a fine-tuning mechanism disclosed in U.S.

Pat. No. 4,497,236 to Rose, which is incorporated herein by reference.

The fine-tuning mechanism is used to adjust or fine tune the pitch of the string 12 by increasing or decreasing string tension. A fine locking tuner bridge saddle 81 is attached to the tremolo base plate 21 by a bridge saddle mounting screw 82. The fine locking tuner bridge saddle 81 pivots between the forward portion 85 and the rear portion 84 about the pin 83.

A string 12 connects at one end to a tuner, which optionally may be a locking tuner, and is clamped in a locking nut at the headstock, traverses the length of the neck, passes over the fixed intonation point 51, and is clamped into the rear portion 84 of the bridge saddle 81. The bridge saddle clamping screw 86 extends from the back of the rear portion 84 and through a slot in the base plate shoulder 88. The bridge saddle clamping screw 86 is tightened to clamp the string 12 securely into the rear portion 84.

The tension on the string 12 generates a force which pulls the rear portion 84 forward toward the neck of the guitar and upward from the base plate 21. The fine tuning adjustment screw 87 is threaded through the horizontal portion of the base plate shoulder 88 and is positioned to make contact with the non-threaded portion of the bridge saddle clamping screw 86.

The string can thus be fine tuned by threading the fine tuning adjustment screw 87. Threading the fine tuning adjustment screw 87 upward results in an upward movement of the bridge saddle clamping screw 86 and the rear portion 84, which in turn causes the pitch of the string 12 to lower as the tension in the string is decreased. Threading the fine tuning adjustment screw 87 downward results in a downward movement of the bridge saddle clamping screw 86 and the rear portion 84, which in turn causes the pitch of the string 12 to increase as the tension in the string is increased.

The fixed intonation point 51 is positioned in the forward portion 85 of the fine tuning mechanism and makes contact with the string 12 at a level above the level at which the string 12 is clamped into the rear portion 84. Because the forward portion 85 and the fixed intonation point 51 remain stationary during adjustment of the fine tuning adjustment screw 87, the length of the string between the critical contact points, the locking nut at the headstock and the fixed intonation point 51, remains constant. Thus, the intonation, or harmonic tuning, of the string 12 is not altered during fine tuning of the pitch of the string.

It will be apparent to those skilled in the art that various modifications can be made to the improved tremolo devices of the instant invention without departing from the scope or spirit of the invention, and it is intended that the present invention cover modifications and variations of the improved tremolo devices provided they come within the scope of the appended claims and their equivalents.

I claim:

1. A guitar comprising:

a body;

a neck attached to said body, said neck having a surface, said surface having an elongated direction;

a headstock attached to said neck, said headstock tilting away from the neck at an angle of between 3 degrees and 15 degrees from the elongated direction of the surface of the neck;

a plurality of locking tuners disposed on said headstock and adjacent the neck;

at least one stud extending from said body, each of said at least one stud further comprising a V-shaped notch;

a tremolo device disposed on said body, said tremolo device further comprising a base plate; said base plate including at least one pivot point; said at least one pivot point of said base plate engaging said V-shaped notch to allow for tilting movement of the tremolo device; and a plurality of strings, whereby each string of said plurality of strings is attached to the tremolo device, extends along the neck of the guitar, and is attached to a corresponding one of said plurality of locking tuners disposed on the headstock.

2. The guitar of claim 1 further comprising a nonlocking-low-friction nut disposed on said neck and adjacent said headstock, whereby each of said plurality of strings extends along the neck of the guitar, passes across the nonlocking-low-friction nut, and is attached to said corresponding one of said plurality of locking tuners disposed on the headstock.

3. The guitar of claim 2, wherein said at least one pivot point comprises a top bevel and a bottom bevel, said top bevel and said bottom bevel jointly defining an edge for engagement with said V-shaped notch of said at least one stud.

4. The guitar of claim 3, wherein said edge defined by said top bevel and said bottom bevel is hard and sharp for providing low-friction, pivoting engagement of said base plate with said at least one stud.

5. The guitar of claim 2, wherein the location of each of said plurality of locking tuners is individually selected for causing each of said plurality of strings to extend from the nonlocking-low-friction nut to the corresponding locking tuner substantially parallel to all other of said strings, and for causing each of said plurality of strings to be substantially equidistant from any adjacent of said strings.

6. The guitar of claim 2, wherein the height of each of said plurality of locking tuners is individually determined for causing each of said plurality of strings to bend towards the headstock at a common angle of between three degrees and fifteen degrees across the nonlocking-low-friction nut.

7. The guitar of claim 6, wherein each of said plurality of strings bends towards the headstock at a common angle of approximately three degrees across the nonlocking-low-friction nut.

8. The guitar of claim 3, wherein said headstock tilts away from the neck at an angle of approximately three degrees from the elongated direction of the surface of the neck, whereby said plurality of strings are forced against the nonlocking-low-friction nut.

9. The guitar of claim 8, wherein the location of each of said plurality of locking tuners is individually selected for causing each of said plurality of strings to extend from the nonlocking-low-friction nut to the corresponding locking tuner substantially parallel to all other of said strings, and for causing each of said plurality of strings to be substantially equidistant from any adjacent of said strings.

10. The guitar of claim 3, wherein the height of each of said plurality of locking tuners is individually determined for causing each of said plurality of strings to bend towards the headstock at a common angle of between 3 degrees and 15 degrees across the nonlocking-low-friction nut.

11. The guitar of claim 8, further comprising a fastener including a mounting shaft being mounted on said body of the guitar, a threaded tremolo-level-adjustment shaft disposed on said mounting shaft, a spring claw movably disposed on said threaded tremolo-level-adjustment shaft, and a pair of nuts movably attached to said threaded tremolo-level-adjustment shaft, said pair of nuts being spaced apart, said spring claw being at least partially disposed between said pair of nuts, and each one of said pair of nuts being configured for independent movement relative to each other and along said threaded tremolo-level-adjustment shaft for adjusting a position of said spring claw relative to said threaded tremolo-level-adjustment shaft.

12. The guitar of claim 9, wherein the height of each of said plurality of locking tuners is individually determined for causing each of said plurality of strings to bend towards the headstock at a common angle of between three degrees and fifteen degrees across the nonlocking-low-friction nut.

13. The guitar of claim 12, wherein said base plate of said tremolo further comprises a plurality of bridge saddles, each of said plurality of bridge saddles is used for clamping a corresponding string of said plurality of strings, and said plurality of bridge saddles are adjustably mounted on said base plate in a manner whereby each of said plurality of bridge saddles can be moved to adjust the length of the corresponding string between the nonlocking-low-friction nut and the bridge saddle, thereby establishing the intonation of the corresponding string.

14. The guitar of claim 10, wherein each of said plurality of strings bends towards the headstock at a common angle of approximately three degrees across the nonlocking-low-friction nut.

15. The guitar of claim 10, wherein the location of each of said plurality of locking tuners is individually selected for causing each of said plurality of strings to extend from the nonlocking-low-friction nut to the corresponding locking tuner substantially parallel to all other of said strings, and for causing each of said plurality of strings to be substantially equidistant from any adjacent of said strings.

16. A guitar comprising:

a body;

a neck attached to said body;

a headstock attached to said neck;

a nonlocking-low-friction nut disposed on said neck adjacent said headstock, and said headstock tilting away from the neck at an angle of between 3 degrees and 15 degrees from the elongated direction of the surface of the neck;

at least one stud extending from said body;

a tremolo device disposed on said body, said tremolo device further comprising a base plate; said base plate including at least one pivot point for tilting movement of the tremolo device; and a plurality of strings, whereby each string of said plurality of strings is attached to the tremolo device, extends along the neck of the guitar, passes over and against the nonlocking-low-friction nut, and is attached to the headstock.

17. The guitar of claim 16, wherein said headstock further comprises a plurality of locking tuners disposed on said headstock for engagement with said plurality of strings.

18. The guitar of claim 17, wherein the location of each of said plurality of locking tuners is individually selected for causing each of said plurality of strings to extend from the nonlocking-low-friction nut to a corresponding one of said plurality of locking tuners locking tuner substantially parallel to all other of said strings, and for causing each of said plurality of strings to be substantially equidistant from each adjacent string.

19. The guitar of claim 17, wherein the height of each of said plurality of locking tuners is individually determined for causing each of said plurality of strings to bend towards the headstock at a common angle of between three degrees and fifteen degrees across the nonlocking-low-friction nut.

20. The guitar of claim 19, wherein each of said plurality of strings bends towards the headstock at a common angle of approximately three degrees across the nonlocking-low-friction nut.

21. The guitar of claim 19, wherein said base plate of said tremolo further comprises a plurality of bridge saddles, each of said plurality of bridge saddles is used for clamping a corresponding string of said plurality of strings, and said plurality of bridge saddles are adjustably mounted on said base plate in a manner whereby each of said plurality of bridge saddles can be moved to adjust the length of the corresponding string between the nonlocking-low-friction nut and the bridge saddle, thereby establishing the intonation of the corresponding string.

22. The guitar of claim 19, wherein said headstock tilts away from the neck at an angle of approximately three degrees from the elongated direction of the surface of the neck, forcing said plurality of strings against the nonlocking-low-friction nut.

23. The guitar of claim 19, wherein said at least one pivot point comprises a top bevel and a bottom bevel, said top bevel and said bottom bevel jointly defining an edge for engagement with said at least one stud.

24. The guitar of claim 19, further comprising a fastener including a mounting shaft being mounted on said body of the guitar, a threaded tremolo-level-adjustment shaft disposed on said mounting shaft, a spring claw movably disposed on said threaded tremolo-level-adjustment shaft, and a pair of nuts movably attached to said threaded tremolo-level-adjustment shaft, said pair of nuts being spaced apart, said spring claw being at least partially disposed between said pair of nuts, and each one of said pair of nuts being configured for independent movement relative to each other and along said threaded tremolo-level-adjustment shaft for adjusting a position of said spring claw relative to said threaded tremolo-level-adjustment shaft.

25. A tremolo system for use with a guitar having a plurality of guitar strings, a body, a neck and a headstock, said tremolo system comprising:

a nonlocking-low-friction nut disposed on said neck adjacent said headstock for providing low friction to the strings which contact said nut;

a plurality of locking tuners disposed on the headstock, wherein each of said plurality of guitar strings is attached to a corresponding one of said locking tuners;

at least one stud extending from the body of the guitar; and a tremolo device, said tremolo device including a base plate, said base plate including at least one pivot point for engagement with said at least one stud for allowing tilting movement of the tremolo device; and whereby said headstock tilts away from the neck at an angle of between 3 degrees and 15 degrees from the elongated direction of the surface of the neck for forcing said plurality of strings against the nonlocking-low-friction nut.

26. The tremolo system as defined in claim 25, wherein each of said at least one stud includes a V-shaped notch, and each of said at least one pivot point comprises a top bevel and a bottom bevel, said top bevel and said bottom bevel jointly defining an edge for engagement with said V-shaped notch of said at least one stud.

27. The tremolo system as defined in claim 26, wherein said edge defined by said top bevel and said bottom bevel is hard and sharp for providing low-friction, pivoting engagement of said base plate with said at least one stud.

28. The tremolo system as defined in claim 25, wherein the location of each of said plurality of locking tuners is selectively positioned to align each of said plurality of guitar strings in a manner in which each of said plurality of guitar strings extends from the nonlocking-low-friction nut to said corresponding locking tuner substantially parallel to all other of said strings and each guitar string is substantially equidistant from any adjacent of said strings.

29. The tremolo system as defined in claim 25, wherein the height of each of said plurality of locking tuners is individually determined for causing each of said plurality of strings to bend towards the headstock at a common angle of between three degrees and fifteen degrees across the nonlocking-low-friction nut.

30. The tremolo system as defined in claim 29, wherein each of said plurality of strings bends towards the headstock at a common angle of approximately three degrees across the nonlocking-low-friction nut.

31. The tremolo system as defined in claim 25, wherein said headstock tilts away from the neck at an angle of approximately three degrees from the elongated direction of the surface of the neck.

32. The tremolo system as defined in claim 31, further comprising a fastener including a mounting shaft being mounted on said body of the guitar, a threaded tremolo-level-adjustment shaft disposed on said mounting shafts, a spring claw movably disposed on said threaded tremolo-level-adjustment shaft, and a pair of nuts movably attached to said threaded tremolo-level-adjustment shaft, said pair of nuts being spaced apart, said spring claw being at least partially disposed between said pair of nuts, and each one of said pair of nuts being configured for independent movement relative to each other and along said threaded tremolo-level-adjustment shaft for adjusting a position of said spring claw relative to said threaded tremolo-level-adjustment shaft.

33. The tremolo system as defined in claim 31, wherein said base plate of said tremolo further comprises a plurality of bridge saddles, each of said plurality of bridge saddles is used for clamping a corresponding string of said plurality of strings, and said plurality of bridge saddles are adjustably mounted on said base plate in a manner whereby each of said plurality of bridge saddles can be moved to adjust the length of the corresponding string between the nonlocking-low-friction nut and the bridge saddle, thereby establishing the intonation of the corresponding string.

34. A guitar comprising:

a body;

a neck attached to said body, said neck having a surface, said surface having an elongated direction;

a headstock attached to said neck;

a plurality of locking tuners disposed on said headstock;

a nonlocking-low-friction nut disposed on said neck and adjacent said headstock;

at least one stud extending from said body;

a tremolo device disposed on said body, said tremolo device further comprising a base plate; said base plate including at least one pivot point; said at least one pivot point of said base plate engaging said at least one stud to allow for tilting movement of the tremolo device; and a plurality of strings, whereby each string of said plurality of strings is attached to the tremolo device, extends along the neck of the guitar, passes across and against the nonlocking-low-friction nut, and is attached to a corresponding one of said plurality of locking tuners disposed on the headstock, each of said plurality of locking tuners having a height that is individually selected for causing each of said plurality of strings to bend across the nonlocking-low-friction nut from the elongated direction of the surface of the neck and towards the headstock at a common angle of between three degrees and fifteen degrees across the nonlocking-low-friction nut.

35. The guitar of claim 34, wherein each of said at least one stud further comprises a V-shaped notch, and wherein each of said at least one pivot point of said base plate engages said V-shaped notch of each of said at least one stud to allow for tilting movement of the tremolo device.

36. The guitar of claim 34, wherein said at least one pivot point comprises a top bevel and a bottom bevel, said top bevel and said bottom bevel jointly defining an edge for engagement with said V-shaped notch of said at least one stud.

37. The guitar of claim 34, wherein the location of each of said plurality of locking tuners is individually selected for causing each of said plurality of strings to extend from the nonlocking-low-friction nut to the corresponding one of said locking tuners substantially parallel to all other of said strings, and for causing each of said plurality of strings to be substantially equidistant from any adjacent of said strings.

38. The guitar of claim 34, wherein said base plate of said tremolo further comprises a plurality of bridge saddles, each of said plurality of bridge saddles is used for clamping a corresponding string of said plurality of strings, and said plurality of bridge saddles are adjustably mounted on said base plate in a manner whereby each of said plurality of bridge saddles can be moved to adjust the length of the corresponding string between the nonlocking-low-friction nut and the bridge saddle, thereby establishing the intonation of the corresponding string.

* * * * *